United States Patent [19]

Bonhomme

[11] Patent Number: 4,587,076

[45] Date of Patent: May 6, 1986

[54] SEALING DEVICE FOR THE DRIVE SHAFT OF A HIGH PRESSURE FLUID PUMP

[75] Inventor: Nicolaas Bonhomme, Pontoise, France

[73] Assignee: Framatome & Cie, Courbevoie, France

[21] Appl. No.: 379,196

[22] Filed: May 17, 1982

[30] Foreign Application Priority Data

May 21, 1981 [FR] France ..... 81 10128

[51] Int. Cl.[4] ..... G21D 1/04

[52] U.S. Cl. ..... 376/203; 415/112; 415/170 A; 415/175; 277/3

[58] Field of Search ..... 376/203, 205; 415/110, 415/111, 112, 170 A, 170 R, 175, 176; 277/3

[56] References Cited

U.S. PATENT DOCUMENTS

| | | | |
|---|---|---|---|
| 3,574,473 | 4/1971 | Gaffal | 415/112 |
| 3,620,639 | 11/1971 | Gaffal et al. | 415/112 |
| 3,651,866 | 3/1972 | Lileg et al. | 415/112 |
| 3,795,460 | 3/1974 | Endo et al. | 415/175 |
| 3,797,963 | 3/1974 | Endo et al. | 415/175 |
| 4,189,156 | 2/1980 | Geary, Jr. et al. | 415/112 |

FOREIGN PATENT DOCUMENTS 2049690 3/1971 France .

*Primary Examiner*—Charles T. Jordan
*Assistant Examiner*—Richard Klein
*Attorney, Agent, or Firm*—Pollock, Vande Sande & Priddy

[57] ABSTRACT

Sealing device for the drive shaft (27) of a high pressure fluid pump comprising a system of seals (33, 34, 35) at least one of which (33) is a hydrostatic seal. Between this hydrostatic seal (33) and the interior of the volute (21) is disposed an auxiliary seal (45) of the mechanical type. The auxiliary seal (45) separates two chambers (46*a*) and (46*b*) which can be brought into communication or isolated by a system of pipes (47) on which a valve (48) is disposed. The invention is particularly applicable to the primary pumps of a pressurized water nuclear reactor.

2 Claims, 3 Drawing Figures

SEALING DEVICE FOR THE DRIVE SHAFT OF A HIGH PRESSURE FLUID PUMP

FIELD OF THE INVENTION

The invention relates to a sealing device for the drive shaft of a high pressure fluid pump.

BACKGROUND OF THE INVENTION

In pressurized water nuclear reactors, the reactor core cooling circuit, or primary circuit, comprises at least two cooling loops, each containing a steam generator and a primary pump.

The primary pumps are composed of a volute, inside which a bladed wheel turns which is rigidly fixed to the bottom end of a drive shaft connected to a motor.

Leaktightness along the drive shaft is achieved by a system of seals disposed in an annular space between the shaft and a casing surrounding this shaft from the point where it passes out of the volute, as far as the drive motor.

The sealing device for the primary pump drive shafts is generally composed of three seals comprising a fixed portion fastened to the casing and a movable portion fastened to the shaft.

The facing surfaces of these sealing elements are either in rubbing contact, in which case the seal is of the mechanical type, or separated by a layer of fluid circulating between the surfaces of the seal, in which case the seal is of the hydrostatic type.

Seals of the mechanical type are generally used for ensuring leaktightness between two zones in which the pressures are not two different from one another, while hydrostatic seals can be used when there is a very great difference in pressure between the two sides of the seal.

In the case of the primary pumps, the water circulated by the pump is at a very high pressure, of the order of 150 bars. The seal disposed in the most upstream position on the drive shaft, i.e., the nearest to the internal part of the pump, is therefore a hydrostatic seal which permits a substantial pressure drop between its upstream side and its downstream side, whereas the seals disposed downstream are generally seals of the mechanical type.

A circuit supplying cold water under high pressure makes it possible to introduce into the annular space delimited by the casing, upstream of the hydrostatic seal, water one part of which is delivered towards the pump volute and another part of which supplies the leakage current of the hydrostatic seal. After passing through the hydrostatic seal, this water is also used for cooling the mechanical seals.

A hydrostatic seal of the kind used as the upstream seal in primary pumps has, for example been described in French Patents Nos. 1,435,568 and 2,049,690.

If a hydrostatic seal of this kind is to function correctly, i.e., without bringing into contact the elements disposed opposite one another and limiting leakage, it is necessary that the pressure drop across this hydrostatic seal, called $\Delta p$, should exceed a certain minimum.

In the case of the primary pumps used at the present time, this pressure limit is of the order of 14 bars.

When the nuclear reactor is operating normally, the reactor cooling water is at a pressure of the order of 150 bars and the cold water injected upstream of the hydrostatic seal is at a slightly higher pressure, so that the pressure drop across the hydrostatic seal is very high, usually close to 150 bars. Satisfactory functioning of the hydrostatic seal is then ensured.

This is no longer the case when the pressure of the primary circuit falls, e.g., when the reactor is stopped, because the cold water injection pressure must be reduced when the primary circuit pressure falls. The flows injected into the volute and into the seal must in fact be balanced, and these flows depend on the pressure of the primary circuit.

Below a certain value of the pressure in the primary circuit, the injection pressure upstream of the hydrostatic seal is no longer sufficient to ensure a $\Delta p$ higher than 14 bars, and the hydrostatic seal can no longer function correctly.

In the case of the primary pumps used in the pressurized water nuclear reactors in service at the present time, it is considered that the minimum primary fluid pressure below which the hydrostatic seal can no longer be operated is of the order of 26 bars.

On the stoppage of a pressurized water nuclear reactor, it is necessary to leave at least one primary pump in operation in order to permit the circulation of the primary fluid and to ensure good cooling.

At the end of the cooling, the water is at a pressure of 26 bars and a temperature of 70° C. At this temperature it is no longer possible to maintain the pressure of 26 bars by utilizing the liquid/vapor equilibrium in the pressurizer of the reactor, and it becomes necessary to use loading pumps of an auxiliary circuit in order to maintain the pressure.

OBJECT OF THE INVENTION

The object of the invention is therefore to propose a sealing device for the drive shaft of a high pressure fluid pump, which sealing device comprises, along the length of this shaft, a system of seals of which at least one is of the hydrostatic type with a leakage of liquid between two elements which limit this leakage, one of which is connected to the shaft while the other is connected to a casing surrounding the shaft and forming an annular space around the latter, this seal, which is disposed in the highest upstream position, i.e., towards the interior of the pump, requiring for its operation a sufficient pressure difference between the portion of the annular space which is upstream of the seal, forming a chamber in communication with the interior of the pump, and the portion of that annular space which is downstream of the seal, this chamber being fed with fluid under a high pressure by a supply circuit, while the sealing device must enable the pump to be kept in operation even if the pressure of the fluid being pumped reaches low values, for example lower than 26 bars.

To this end, the sealing device according to the invention comprises, in addition:

(a) an auxiliary seal of the mechanical type, in which one of the mutually facing parts in rubbing contact is joined to the shaft and the other to the casing, and which is disposed in the chamber, upstream of the pressurized fluid inlet, thus dividing this chamber into an upstream portion and a downstream portion, and (b) a pipe disposed between the upstream and downstream portions of the chamber, a valve enabling the two portions of the chamber to be isolated or brought into communication being provided on this pipe.

BRIEF DESCRIPTION OF THE DRAWINGS

In order to enable the invention to be clearly understood a description will now be given, by way of example and with reference to the accompanying drawings, of a primary pump for a pressurized water nuclear reactor, which pump is equipped with a sealing device according to the invention.

DESCRIPTION OF PREFERRED EMBODIMENT

Figure 1:
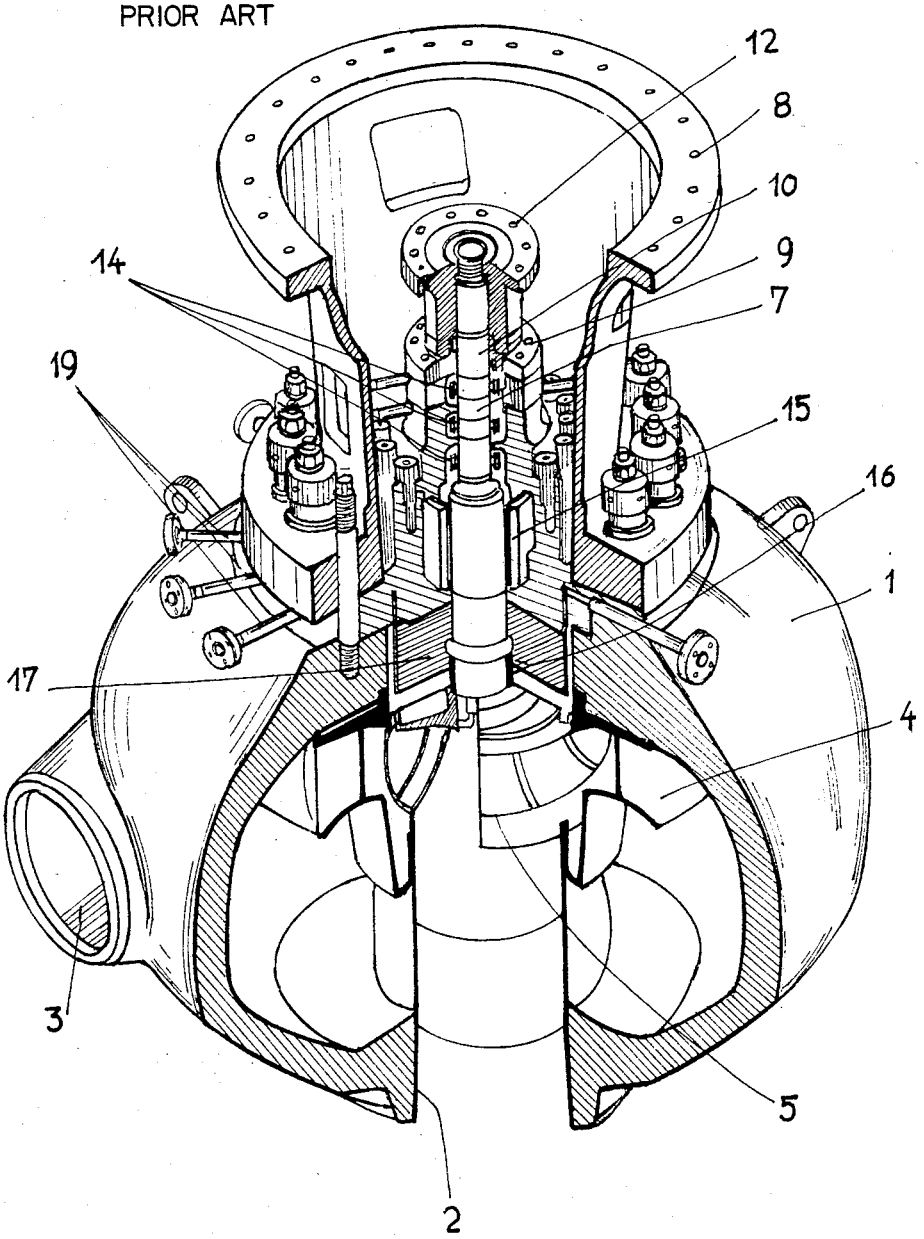
Fig 1 PRIOR ART
FIG. 1 is an exploded view in perspective of a primary pump according to the prior art.

In FIG. 1 can be seen a pump comprising a pump body or volute 1 having a suction opening 2 and a delivery opening 3.

Inside this volute is disposed a diffuser 4, inside which rotates the bladed wheel 5 fixed to the drive shaft 7 connected to the pump drive motor (not shown).

The top part of the pump body is provided with a coupling flange 8 enabling the pump to be joined to its motor unit.

The shaft 7 is surrounded by a casing 9 which forms an annular space 10 around it.

The top the casing 9 is provided with a flange 12 for connection to the pump drive motor.

Seals 14 enabling leaktightness to be ensured along the shaft 7 are disposed in the annular space 10.

The shaft 7 carries the bladed wheel 5 at its end which penetrates into the volute, and it passes out of the volute through a labyrinth seal 16 at the level of which is also disposed a heat barrier 17 through which a cooling coil passes. The shaft 7 then passes into a bearing 15 which supports and guides it.

The seal 14 disposed in the most upstream position, i.e., towards the interior of the pump and therefore closest to the bearing 15, is of the hydrostatic type, cold water under a pressure slightly higher than the water pressure in the pump being injected through injection pipes 19 into the annular space 10 in which the seals are disposed.

Figure 2:
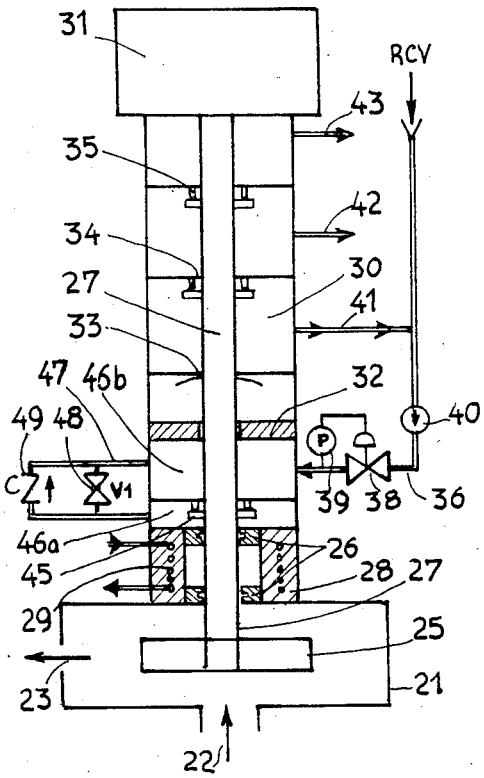
FIG. 2 shows diagrammatically the sealing device according to the invention.

FIG. 2 shows a diagrammatic representation of the sealing device associated with a primary pump of the same type as the pump shown in FIG. 1.

In the interior of the volute 21 of this pump, which has a suction opening 22 and a delivery opening 23, the bladed wheel 25 fixed to the end of the shaft 27 is rotated by means of this shaft. On leaving the volute 21 the shaft passes into an arrangement comprising two labyrinth seals 26, which are in turn surrounded by the heat barrier 28, through which passes a coil 29 fed with cooling water.

The shaft 27 then passes through the annular space 30 delimited by a casing disposed around the shaft over its entire length, as far as its connection to the drive motor 31.

The bearing 32 permitting the guiding of the shaft, and the seals 33, 34 and 35, are disposed inside this annular space.

The first seal 33 disposed upstream is of the hydrostatic type with leakage of liquid between its rotating part joined to the shaft 27 and its fixed part joined to the casing.

The seals 34 and 35 are of the mechanical type, comprising two parts in rubbing contact, one of which is fixed to the shaft and the other to the casing.

A pressurized cold water supply circuit 36 enables cold water, at a pressure slightly higher than the pressure of the water circulated by the pump, to be introduced into the annular space 30, upstream of the seal 33.

The pressure of this cold water is regulated with the aid of a bypass valve 38 and a loading pump 40 connected in a bypass on the main line of the circuit 36. A pressure gauge 39 enables the pressure in the circuit 36 to be checked. Pipes 41, 42 and 43 enable the water recovered downstream of the seal 33 to be recycled to the supply circuit 36.

The sealing device according to the invention contains in addition an auxiliary seal 45 disposed upstream of the hydrostatic seal 33 in that portion of the annular space 30 which constitutes a chamber 46 in communication with the interior of the volute 21 by way of the labyrinth seals 26.

The auxiliary seal 45 is a mechanical seal with surfaces in rubbing contact, which divides the chamber 46 into two parts, namely a part 46*a* situated upstream of the seal 45 and a part 46*b* situated downstream of the seal 45 and upstream of the seal 33.

A pipe 47 enables the two parts 46*a* and 46*b* of the chamber 46 to be connected. A valve 48 is disposed on the pipe 47 in order to enable the two parts of the chamber 46 to be isolated or brought into communication.

A non-return valve 49 is connected in a bypass relative to the valve 48.

Figure 3:
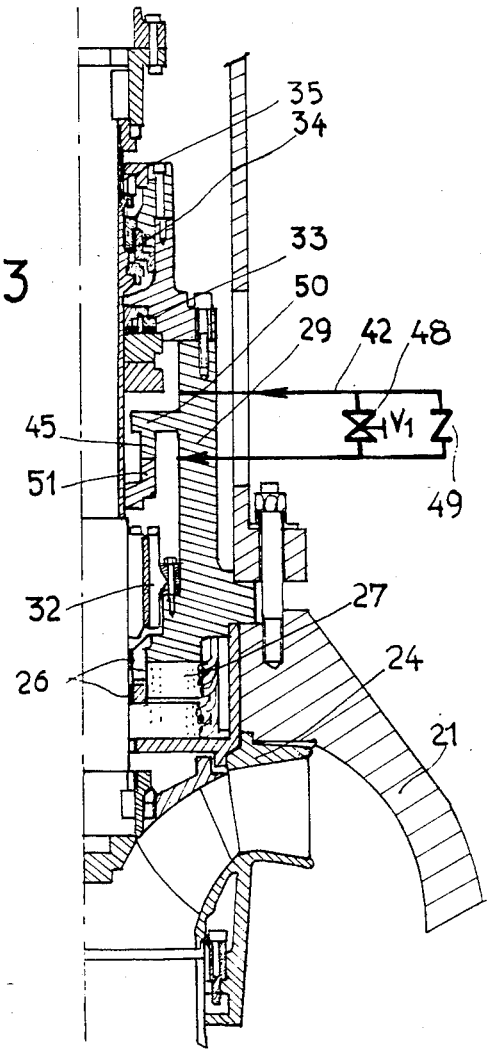
FIG. 3 is a half-view in section, through a vertical plane of symmetry, of the top part of a primary pump for a nuclear reactor, incorporating a sealing device according to the invention.

Referring to FIG. 3, the same elements are found as those shown in FIG. 2 and are given the same reference numerals, the primary pump being of the same type as the pump shown in FIG. 1.

In FIG. 3, however, the circuit 36 has been omitted in order to avoid complicating the drawing.

The auxiliary seal 45 is composed of a fixed part fastened to the casing 9′ and a movable part 51 fastened to the shaft 27, the facing surfaces of these parts being in rubbing contact.

The hydrostatic seal 33 consists of a floating packing and a rotating packing, these packings being separated by a controlled leakage water film. The thickness of the film of water (filtered water injected upstream of the seal 33 into the chamber 46*b* by the circuit 36) is regulated by the geometric profile of the operative parts in dependence on the pressure in the chamber 46*b*. Water leaking from this seal 33 is partly discharged through the seal 34, the remainder passing towards the circuit 36 by way of the pipe 41 (FIG. 2).

A description will now be give, with reference to FIGS. 2 and 3, of the operation of the sealing device according to the invention.

During the normal operation of the pump, with the nuclear reactor in service, the pump circulates the water of the primary circuit, which is at a pressure of the order of 150 bars and at a temperature higher than 300° C. The valve 48 disposed on the pipe 47 and bringing the two parts of the chamber 46 into communication is open. Cold water is supplied by the circuit 36 into the part 46*b* of the chamber, at a pressure slightly higher than the pressure of the primary circuit. Establishing communication between the two parts 46*a* and 46*b* of the chamber 46 by way of the pipe 47 brings about pressure equilibrium between these two parts of the chamber, so that the difference in pressure across the auxiliary seal 45 is negligible. Rubbing contact can thus be provided between the mutually facing surfaces of the seal 45, with a low application pressure, so that wear on this seal is very limited. Moreover, the seal 45 is cooled by the water from the circuit 36 and works at a moderate temperature.

The sealing device then functions like the devices of the prior art, the difference in pressure across the hydrostatic seal 33 being practically equal to the overpressure of the primary circuit.

During a stoppage of the reactor the primary circuit pressure may decrease to a low value, for example lower than 26 bars. In order to keep the pump in working order, it is then sufficient to close the valve 48 and regulate the flow and pressure of the cold water injected through the circuit 36, by acting on the valve 38 and the pump 40, in such a manner as to maintain an adequate pressure in the chamber **46*b* delimited by the hydrostatic seal 33 and the auxiliary seal 45. This pressure will preferably be selected to be equal to 26 bars, so as to be just above the minimum threshold of the $\Delta p$ permitting the operation of the seal 33**.

Under these conditions the difference in pressure between the chamber **46*b*, subjected to a pressure close to 26 bars, and the chamber 46*a*, subjected to a pressure close to that of the primary circuit, is at most equal to 26 bars, so that the drop in pressure from one side of the seal 45** to the other is at most equal to that value.

This is compatible with satisfactory operation of the seal 45.

In all cases the rubbing surface seals of the sealing device shown in FIGS. 2 and 3 operate under good conditions, because the pressure drops from one side of these seals to the other are low and the circulation of the water coming into contact with these seals permits the lubrication of the rubbing surfaces. The seal 45 is cooled and lubricated by the water injected by the circuit 36, while the seals 34 and 35 are cooled and lubricated by part of the water passing through the seal 33. This water, permitting cooling and lubrication, is finally recycled through the pipes 41, 42 and 43.

The non-return valve 49 connected in a bypass relative to the valve 48 is designed to remain closed as long as the pressure in the chamber **46*a* is lower than the pressure in the chamber 46*b*. This non-return valve opens only if the pressure in the chamber 46*a* is higher than that in the chamber 46*b*. During the normal operation of the reactor this non-return valve therefore remains closed because the circuit 36** introduces water at a slightly higher pressure than the pressure of the primary circuit water.

During a stoppage of the reactor, the pressure being brought to a low value in the primary circuit and the valve 48 being closed, if damage occurs in the supply circuit 36 the pressure in the chamber **46*a* becomes higher than the pressure in the chamber 46*b*, which is no longer being fed, and the clack valve 49 opens, so that the primary circuit water cooled by the heat barrier 28 can penetrate into the chamber 46*b* and take over the function of cooling and lubricating the rubbing-surface seals in place of the cold water injected by the circuit 36**.

One advantage of the device according to the invention is that it permits the operation of the primary pumps of a nuclear reactor at low pressure. During the stoppage phases of the reactor it becomes possible to continue to circulate the primary circuit water without needing auxiliary means to keep its pressure above 26 bars.

Moreover, the reactor cooling circuit which makes it possible to lower the temperature and pressure of the primary circuit in the course of the phases of the cold stoppage of the reactor can be used at pressures lower than 26 bars, which previously was not possible because a circulation of the primary water must be maintained during the stoppage phases.

This has the consequence that this cooling circuit can be used until the last phases of the cold stoppage of the reactor.

However, the invention is not limited to the embodiment just described, but on the contrary includes all variants thereof.

Thus, seals of any type may be associated with the hydrostatic seal disposed upstream of the sealing device, and the number of these seals is not limited.

It is also possible to conceive the use of a sealing device according to the invention in the case of a pump for highly pressurized fluid of a type different from a pump for circulating the primary circuit water in a pressurized water nuclear reactor.

I claim:

1. A pump for circulating a high pressure fluid, comprising a volute, a bladed wheel mounted on said volute, a shaft one end of which is connected to said wheel and the other end of which is connected to a drive motor outside said volute, a casing fixed to said volute around an aperture in said volute for the passage of said shaft, prolonging said volute and surrounding said shaft up to said drive motor, an annular space being provided between the internal surface of said casing and said shaft, and a set of seals disposed in said annular space in sequence along said shaft, at least one of said seals being of the hydrostatic type comprising two sealing elements respectively connected to said shaft and to said casing and maintaining a small space between them, the seal of said set which is disposed furthest upstream, i.e., closest to the interior of said volute, being of said hydrostatic type and limiting upstream of its sealing elements a portion of said annular space constituting a chamber in communication with the interior of said volute, said pump further comprising a supply circuit connected to said chamber at a supply point for feeding said chamber with a liquid at a pressure higher than the pressure of the fluid circulated by said pump, said pump further comprising (a) an auxiliary seal of the mechanical type provided in addition to the seals of said set, said auxiliary seal comprising two sealing elements in rubbing contact and respectively connected to said shaft and to said casing within said chamber upstream of said supply point, thereby dividing said chamber into an upstream portion and a downstream portion;

(b) a conduit extending between said upstream and downstream portions of said chamber, said conduit being provided with a valve for selectively isolating and communicating said chamber portions; and (c) a non-return valve connected in a bypass of said first-mentioned valve, said non-return valve being adapted to open when the pressure in said upstream chamber portion exceeds the pressure in said downstream chamber portion.

2. A pump according to claim 1, wherein said pump is used for circulating the primary water of a pressurized water nuclear reactor, wherein said set of seals comprises a said hydrostatic seal and first and second mechanical seals, and wherein said auxiliary mechanical seal is located between a heat barrier and a bearing in said annular space.

* * * * *